US006564484B1

(12) United States Patent
Ikenaga et al.

(10) Patent No.: US 6,564,484 B1
(45) Date of Patent: May 20, 2003

(54) SWIMMING ELEMENT ENJOYING SYSTEM

(75) Inventors: Nobuhiro Ikenaga, Tokyo (JP); Noriyuki Inomata, Tokyo (JP)

(73) Assignees: Takara Co., Ltd, Tokyo (JP); Yukasha Co., Ltd, Tokyo (JP)

( * ) Notice: Subject to any disclaimer, the term of this patent is extended or adjusted under 35 U.S.C. 154(b) by 55 days.

(21) Appl. No.: 09/654,739

(22) Filed: Sep. 5, 2000

(30) Foreign Application Priority Data

May 22, 2000 (JP) ..... 2000-150650

(51) Int. Cl.[7] ..... G09F 19/00

(52) U.S. Cl. ..... 40/426; 40/406; 40/409; 40/457

(58) Field of Search ..... 40/406, 426, 409, 40/455, 457, 433

(56) References Cited

U.S. PATENT DOCUMENTS 4,703,573 A * 11/1987 Montgomery et al. ..... 40/455
5,018,288 A * 5/1991 Yang ..... 40/406
5,301,444 A * 4/1994 Horiuchi ..... 40/406
5,417,605 A 5/1995 Chan
5,603,994 A * 2/1997 Su ..... 40/426
6,006,461 A * 12/1999 Snyder ..... 40/406
6,131,318 A * 10/2000 Hsieh ..... 40/406

FOREIGN PATENT DOCUMENTS

| | | | |
|---|---|---|---|
| DE | 942856 | 5/1956 | |
| EP | 584944 | 3/1994 | |
| EP | 627248 | 12/1994 | |
| JP | 3-184585 | * 8/1991 | ..... A63H/33/22 |

* cited by examiner

*Primary Examiner*—Cassandra H. Davis

(57) ABSTRACT

A swimming element enjoying system capable of applying an external stimulus to a swimming element moved at a predetermined rhythm, to thereby permit the swimming element to carry out different motion, to thereby provide an observer with a fresh surprise, so that the observer may be soothed or healed. A swimming element made in imitation of an aquatic life and a drive unit for driving the swimming element each are provided with a permanent magnet. The permanent magnet of the drive unit is rotated, to thereby permit an attracting/repulsing action to be carried out between the permanent magnets, leading to random vertical motion of said swimming element. Motion of the swimming element is randomly varied when a sensor detects an external stimulus.

13 Claims, 10 Drawing Sheets

SWIMMING ELEMENT ENJOYING SYSTEM

BACKGROUND OF THE INVENTION

This invention relates to a system for enjoying a swimming object or element (hereinafter referred to as "swimming element enjoying system"), and more particularly to a swimming element enjoying system which permits a swimming element formed in imitation of an aquatic life such as a jellyfish or the like to swim by attracting and repulsing force between permanent magnets in an aquarium, to thereby provide an observer with visual pleasant.

There have been conventionally proposed a variety of kinds of toys such as a toy moved by a magnetic force of a permanent magnet, a toy moved by operation of a sensor and the like. The toy utilizing magnetic force is constructed so as to constantly repeat predetermined motion by the magnetic force and the toy having the sensor incorporated therein is constructed so as to be moved when the sensor detects a predetermined stimulus.

Such conventional toys have been developed independently from each other. Thus, the toy utilizing magnetic force merely repeats predetermined motion and the toy using a sensor merely carries out motion only when the sensor detects a predetermined stimulus. Thus, the conventional toys are readily antiquated, to thereby fail to significantly maintain an observer's interest.

Also, an electronic pet which is so constructed that motion of a toy made in imitation of a dog, a cat or the like is electronically controlled has been recently proposed for the purpose of relaxing or healing mental pain. Unfortunately, it fails to satisfactorily carry out relaxation or healing of mental pain.

SUMMARY OF THE INVENTION

The present invention has been made in view of the foregoing disadvantage of the prior art.

Accordingly, it is an object of the present invention to provide a swimming element enjoying system which is capable of giving any external stimulus to a swimming object being moved at a predetermined rhythm, to thereby permit the swimming element to carry out unexpected motion, resulting in providing an observer with a fresh surprise and exhibiting a soothing or healing effect.

In accordance with the present invention, a swimming element enjoying system is provided. The swimming element enjoying system includes a body including an aquarium in which liquid is stored, a swimming element moved in the aquarium, and a drive unit for randomly moving the swimming element in the aquarium. The swimming element and drive unit each are provided with a permanent magnet. The permanent magnet of the drive unit is rotated by means of a motor, to thereby permit an attracting/repulsing action to be carried out between the permanent magnets, leading to random vertical motion of the swimming element. The drive unit includes a sensor for detecting an external stimulus and a control circuit for varying a rotational speed of the motor when the sensor detects the external stimulus.

In a preferred embodiment of the present invention, the control circuit preferably includes a pulse generation circuit for generating a pulse and a selection circuit for determining whether the pulse generated by the pulse generation circuit is to be outputted in the form of a drive signal on the basis of a result of detection by the sensor. The drive signal is continuously outputted unless the pulse is outputted as the drive signal.

In a preferred embodiment of the present invention, the swimming element enjoying system preferably further includes a light-permeable rotation plate classified into a plurality of colors, an illumination means for upwardly illuminating the rotation plate from below and a rotation drive unit for rotating the rotation plate. The rotation plate, illumination means and rotation drive unit are arranged below the body.

In a preferred embodiment of the present invention, the swimming element preferably has specific gravity set so as to permit the swimming element to gently sink in the liquid when it is placed in the liquid.

In a preferred embodiment of the present invention, the sensor is preferably a sound sensor.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENT

Now, a swimming element enjoying system according to the present invention will be described with reference to the accompanying drawings.

Figure 1:
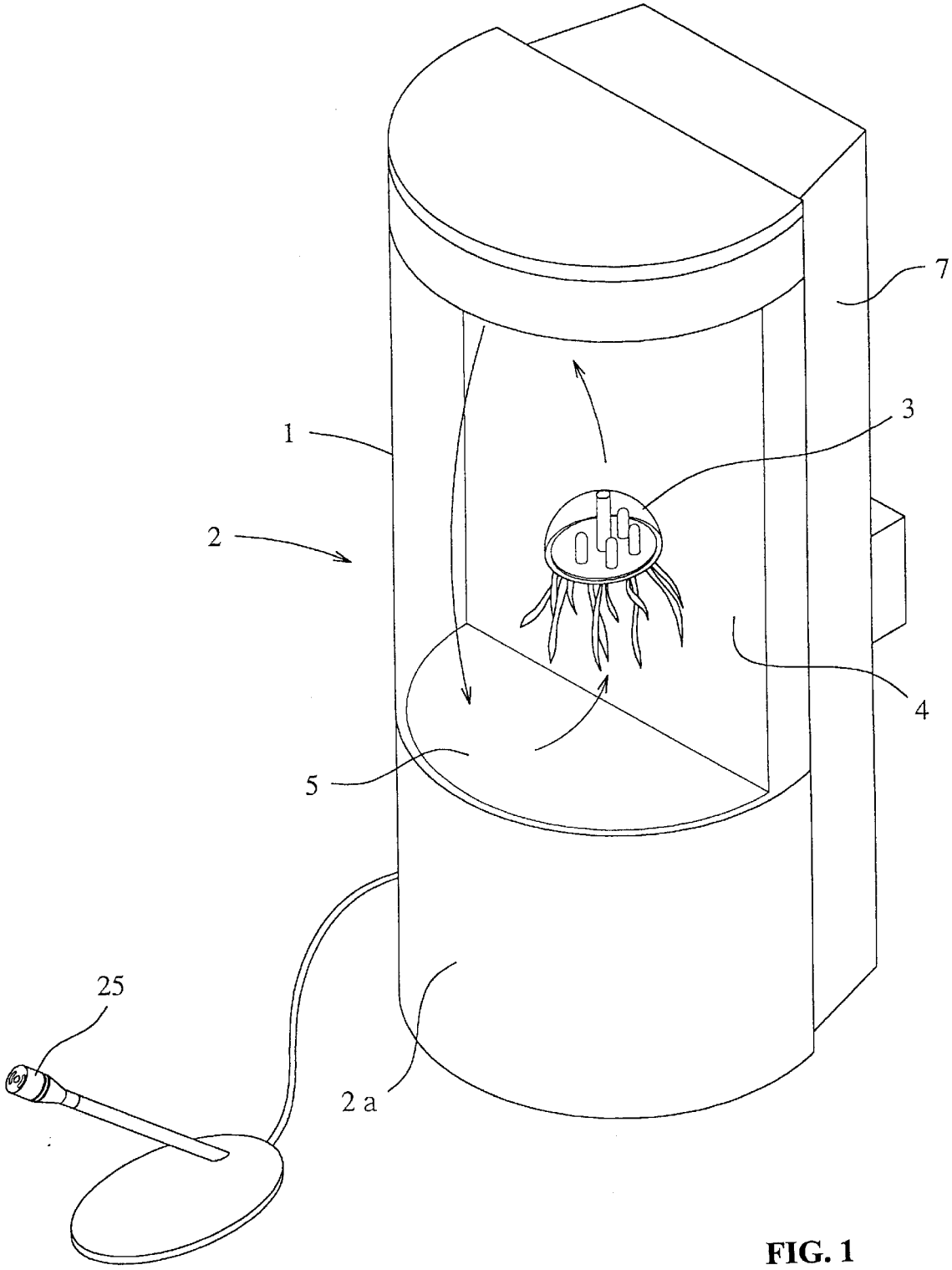
FIG. 1 is a perspective view showing an embodiment of a swimming element enjoying system according to the present invention.

Referring first to FIG. 1, an embodiment of a swimming element enjoying system according to the present invention is illustrated. A swimming element enjoying system of the illustrated embodiment generally includes a container-like body 2 including an aquarium 1 in which liquid is received, a swimming object or element moved in the container-like body 2, and a drive unit for moving the swimming element 3.

Figure 2:
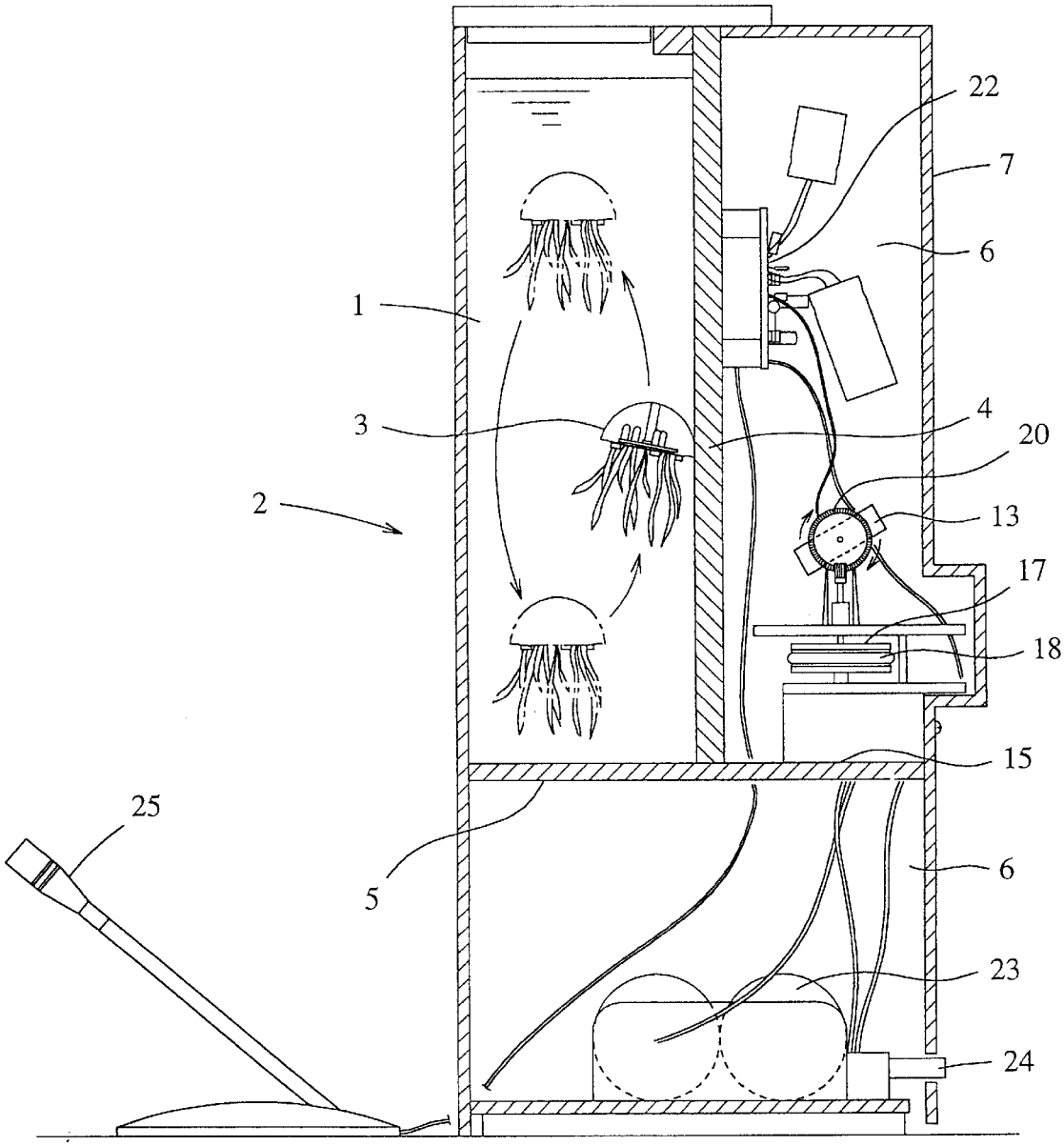
FIG. 2 is a vertical sectional view of the swimming element enjoying system shown in FIG. 1.

The container-like body 2 is constituted by the aquarium 1 formed into a semi-cylindrical shape and so as to extend in a longitudinal direction thereof and a unit mounting space 6 defined by a rear side plate member 4 mounted on a rear side of the aquarium 1 and a bottom side plate member 5 mounted on a bottom side thereof as shown in FIG. 2. The rear side plate member 4 arranged on the rear side of the aquarium 1 is formed thereon with a suitable pattern acting as a background of the aquarium 1. The unit mounting space 6 is defined by a cooperation of the rear side plate member 4, the bottom side plate member 5 and a rear cover 7.

The aquarium 1 is filled therein with water. The aquarium 1 has a curved front side formed of a transparent plate member. The above-described plate member 5 on the bottom side of the aquarium 1 is likewise formed of a transparent material. The transparent bottom side plate member 5 is arranged above a lower end of the container-like body 2. The aquarium 1 constituting a front side of the container-like body 2 has suitable printing applied to a lower section 2*a* thereof, resulting in the lower section 2*a* being opaque. This permits the pattern on the rear plate member 4 to be reflected in the transparent bottom side plate member 5, to thereby keep the unit and the like arranged below the bottom side plate member out of sight. Alternatively, this may be attained by forming the bottom side plate member 5 of an opaque material. The aquarium 1 is formed so as to extend in the longitudinal direction thereof, so that the swimming element 3 may be suitably moved in a vertical direction.

Figure 3:
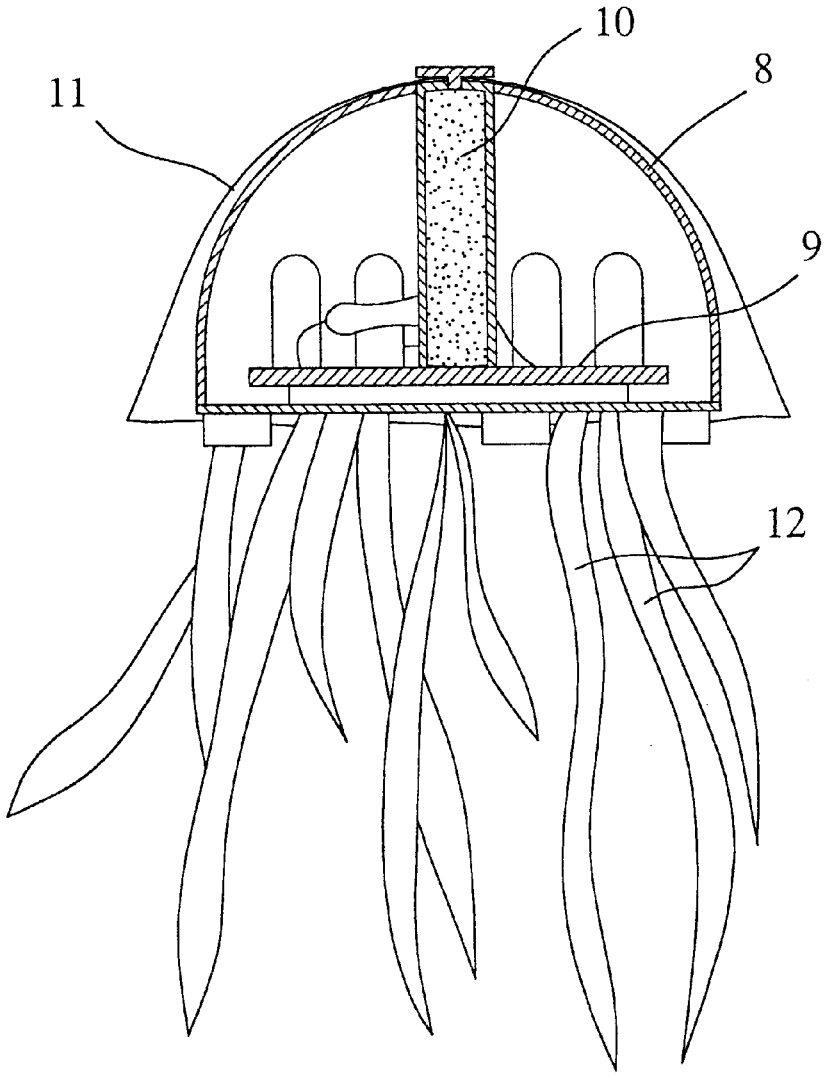
FIG. 3 is a sectional view showing a swimming element.

The swimming element 3, as shown in FIG. 3, is formed in imitation of a jellyfish. More particularly, the swimming element 3 includes a transparent member 8 of a hemispherical shape which is made of a transparent plastic material or the like. The hemispherical member 8 has any suitable decoration received therein. Also, the hemispherical member 8 is provided therein with a bar-like permanent magnet 10 in a manner to be positioned in a central region thereof. Further, the hemispherical member 8 is provided on an upper portion thereof with a thin cover 11 and on a lower portion thereof with a plurality of soft leg members 12 in a manner to be suspended therefrom. The swimming element 3 is formed so as to have specific gravity slightly lager than that of water, so that it may be kept stationarily sinking on the bottom of the aquarium 1 unless any force acts thereon. On the contrary, when the swimming element 3 has specific gravity smaller than one (1), force at a large magnitude is required to sink the swimming element 3 kept floating in water to the bottom of the aquarium 1. The swimming element 3 is not limited to a jellyfish. Thus, it may be formed in imitation of any other suitable aquatic life.

Figure 4:
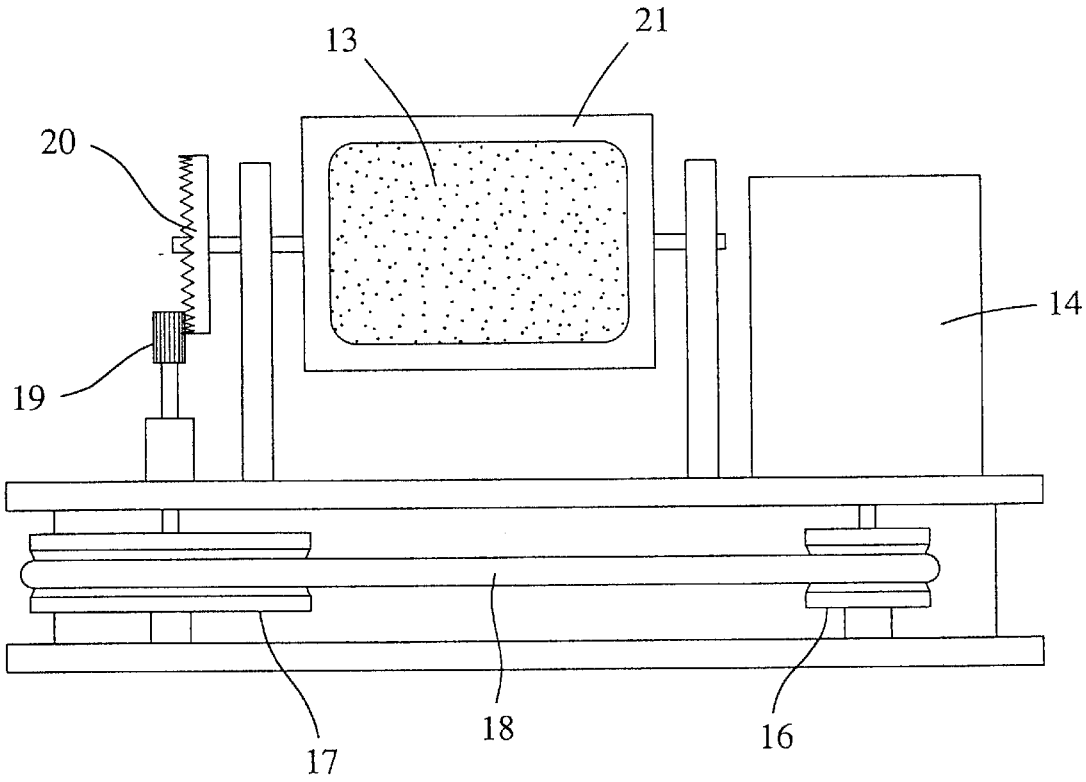
FIG. 4 is a front elevation view showing a drive unit for a permanent magnet.

The unit mounting space 6 is provided therein with the drive unit briefly described above. The drive unit has a permanent magnet 13 and a motor 14 for rotating the permanent magnet 13 arranged behind the rear side plate member 4 of the aquarium 1. As shown in FIGS. 2 and 4, the motor 14 is mounted on one of sides of an upper surface of a mounting plate 15. The motor 14 includes an output shaft on which a pulley 16 of a small diameter is fixedly mounted. The mounting plate 15 is mounted on the other side of the upper surface thereof with a pulley 17 of a large diameter. The pulleys 16 and 17 are connected to each other through a belt 18 arranged thereon so as to extend therebetween. The large-diameter pulley 17 has a revolving shaft on which a gear 19 is fixedly mounted, which is then engaged with a crown gear 20. The crown gear 20 has a revolving shaft 21 fixedly mounted thereon with a frame 21, on which the permanent magnet 13 is held. The drive unit also includes a circuit board 22 securely arranged above the permanent magnet 13 so as to control rotation of the motor 14, as well as a battery 23 arranged below the permanent magnet 13. Reference numeral 24 designates a switch.

A mechanism for transmitting rotation of the motor 14 to the permanent magnet 13 is not limited to such a pulley mechanism as described above. It may be attained by a gear connection mechanism. The motor 14 may be driven by electric power fed thereto through an AC adaptor from a commercial power supply.

Now, the manner of operation of the drive unit thus constructed will be described.

Figure 5:
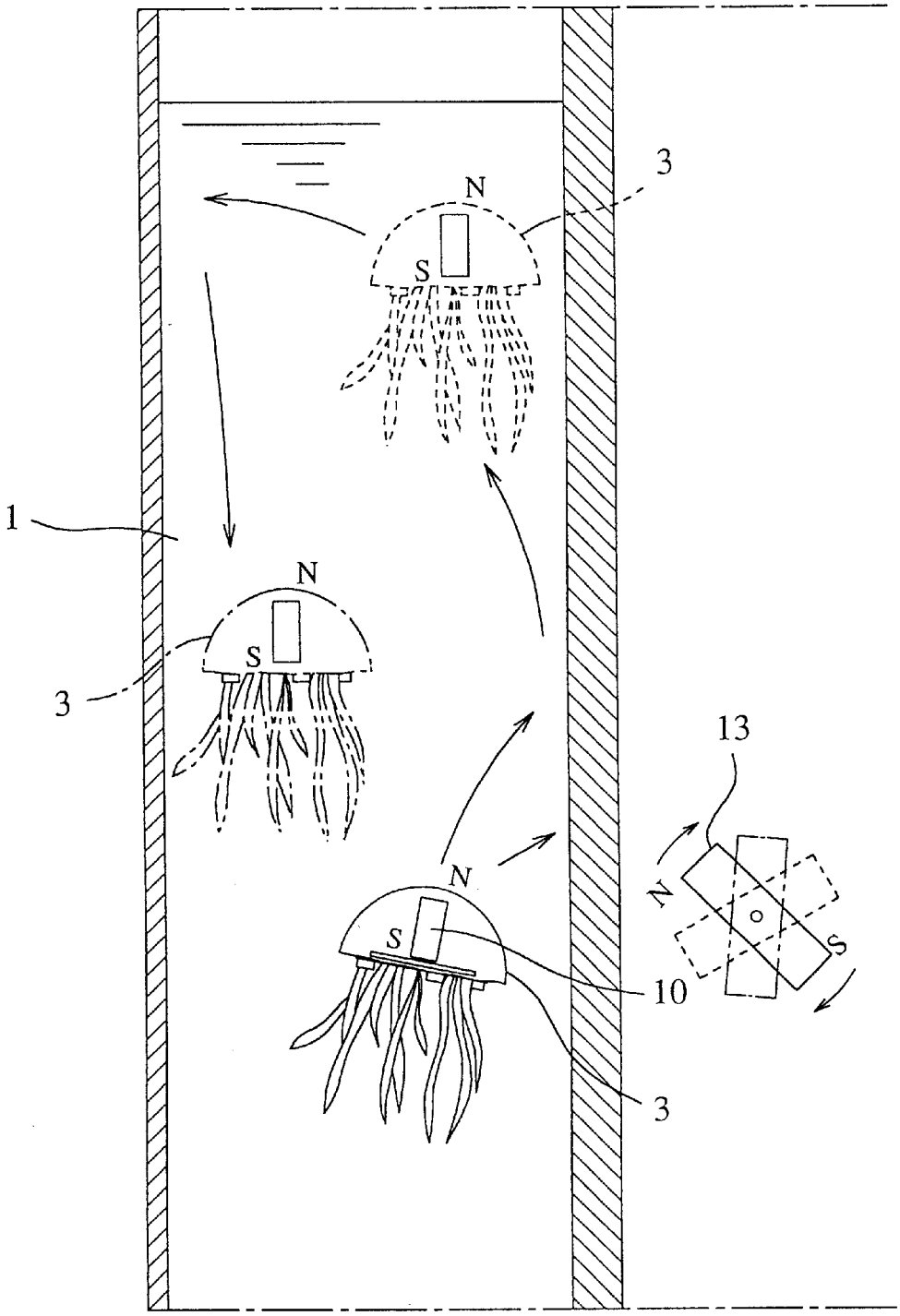
FIG. 5 is a schematic sectional view showing a manner of motion of a swimming element.

When the switch 24 is turned on, the motor 14 is driven, leading to rotation of the permanent magnet 13 as shown in FIG. 5. A magnetic field of the permanent magnet 13 rotating and that generated from the permanent magnet 10 of the swimming element 3 each change momentarily. The swimming element 3 is somewhat heavier that water; so that when the magnetic field acts in a direction in which the swimming element 3 sinks in the water, the swimming element 3 is permitted to sink toward the bottom of the aquarium 1. Then, when the permanent magnets 10 and 13 attract each other, the attraction force permits the swimming element 3 to approach the permanent magnet 13. On the contrary, when the permanent magnets 10 and 13 repel each other, the swimming element is permitted to upwardly move. This results in the swimming element 3 being randomly moved in the aquarium 1 depending on a continuous variation in magnetic field of each of the permanent magnets 10 and 13 due to continuous random attraction and repulsion between the permanent magnets 10 and 13. As described above, the bar-like permanent magnet 10 of the swimming element 3 is vertically arranged and the revolving shaft 21 of the permanent magnet 13 is horizontally arranged, an action of magnetic force between the permanent magnets 10 and 13 is vertically directed. This permits the swimming element 3 to move in a wavering manner due to attraction and repulsion between the permanent magnets 10 and 13 while being vertically moved and rotated.

The drive unit described above includes a sensor for detecting any external stimulus such as sound or the like and a control circuit for varying a rotational speed of the above-described motor when the sensor detects sound. The control circuit includes a pulse generation circuit for generating a pulse and a selection circuit for determining whether the pulse generated from the pulse generation circuit is to be outputted in the form of a drive signal depending on a result of detection by the sensor. Also, the control circuit is so constructed that when the pulse is not outputted as a drive signal, the above-described drive signal is successively outputted.

Figure 6:
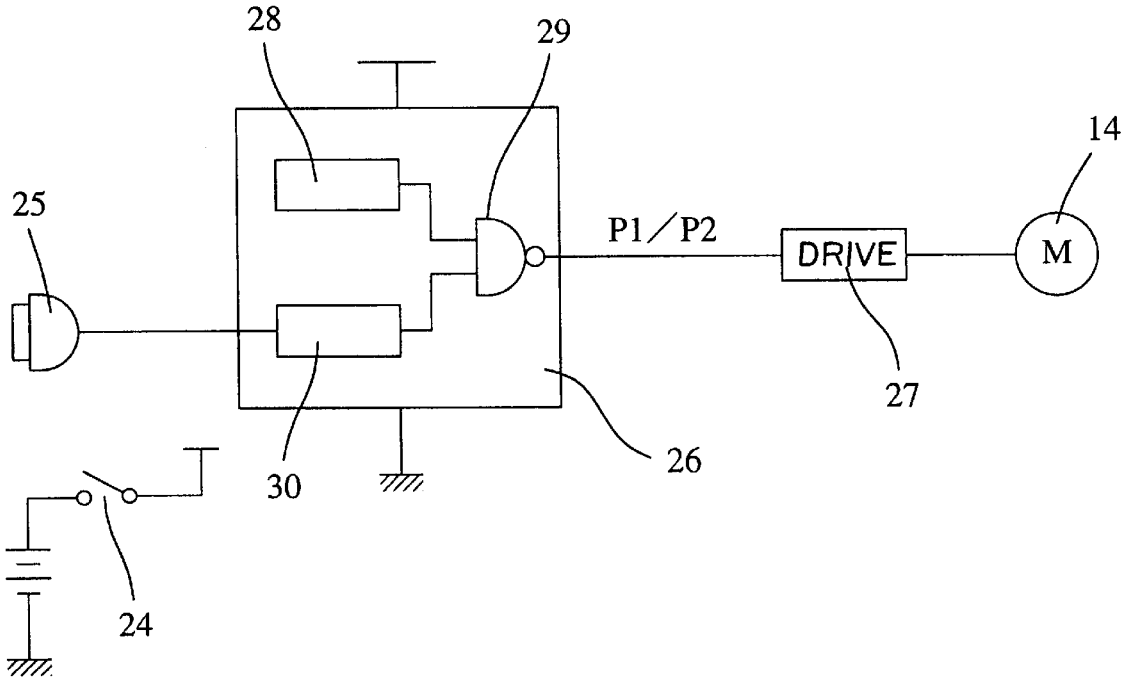
FIG. 6 is a block diagram showing an electric circuit incorporated in the swimming element enjoying system of FIG. 1.
Figure 7:
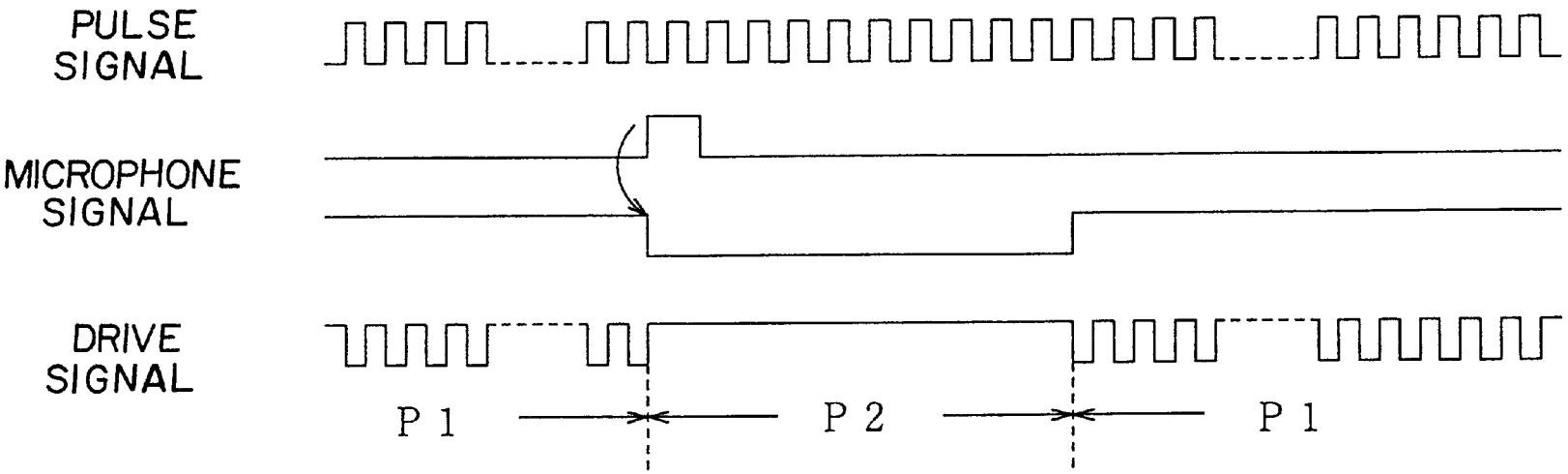
FIG. 7 is a time chart showing operation of the swimming element enjoying system of FIG. 1.

Now, the swimming element enjoying system of the illustrated embodiment will be described with reference to FIG. 6 by way of example. The swimming element enjoying system is constituted by a sensor (microphone) 25 for detecting sound, a control circuit 26, a drive circuit 27 for rotating the motor on the basis of a drive signal generated from the control circuit 26, and the motor 14. The control circuit 26 is constructed so as to output a pulse-like drive signal P1 which repeats ON/OFF in a normal state and output a drive signal P2 kept ON for a predetermined period of time when the microphone detects sound.

The control circuit 26 may be constituted by a multivibrator (pulse generation circuit) 28 and a gate circuit (NAND circuit, selection circuit) 29. An output of the multivibrator 28 is fed to one of input terminals of the NAND circuit 29 and a detection signal of the microphone 25 is fed to a shaping circuit 30, in which the detection signal is converted into a control signal kept at a low level for a predetermined period of time and then fed to the other input terminal of the NAND circuit 29. When the microphone 5 does not detect external stimulus or sound, the control signal is kept high, so that the NAND circuit 29 may be fed at an output terminal thereof with the pulse-like drive signal P1 repeating ON/OFF; whereas when the microphone 25 detects sound, the control signal is rendered low, so that the drive signal P2 kept ON may be fed to the output terminal of the NAND circuit 29 during a period of time for which the control signal is kept low.

Figure 8:
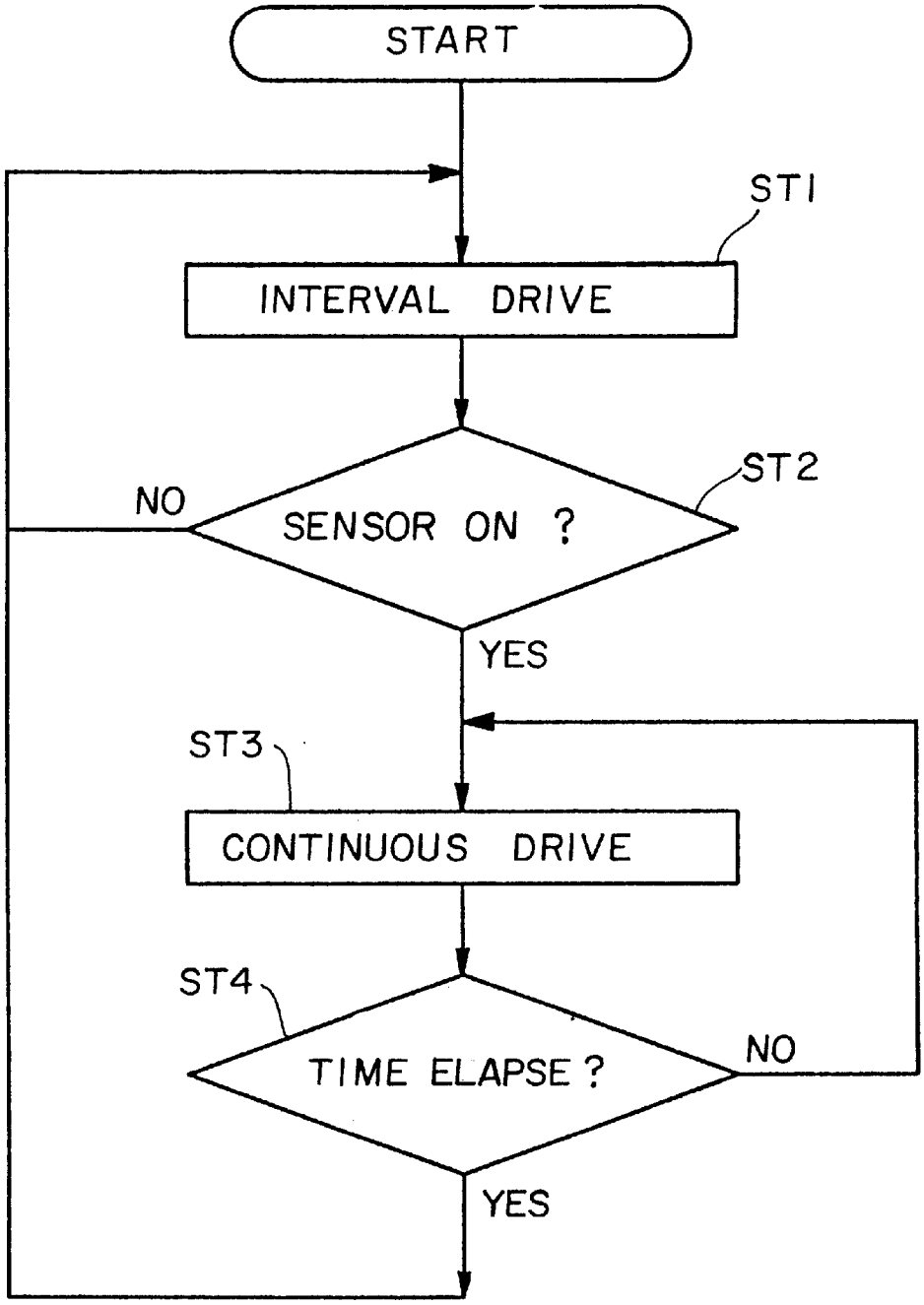
FIG. 8 is a flow chart showing operation of the swimming element enjoying system of FIG. 1.

Now, the manner of operation of the swimming element enjoying system of the illustrated embodiment thus constructed will be described with reference to FIG. 8.

When the power supply is turned on, the control circuit 26 generates the drive signal P1, leading to interval driving of the motor 14 (step ST1). During the interval driving in which the motor 14 is intermittently driven, a voltage applied to the motor 14 alternately repeats ON/OFF, so that the motor 14 alternately repeats rotation and interruption, resulting in carrying out rotation at a low speed.

When the microphone 25 detects sound during the interval driving of the motor 14 (step ST3), the control circuit 26 generates the drive signal P2, to thereby continuously drive the motor 14. During continues driving of the motor 14, application of a voltage to the motor 14 is continuously kept, so that the motor 14 is continuously rotated without interruption, resulting in being rotated at a high speed. Then, when a predetermined period of time elapses (step ST4), the operation is returned to the step ST1, so that the control circuit outputs the drive signal P1 again, to thereby subject the motor 14 to interval driving until the microphone 25 detects sound.

Thus, when an observer generates voice, the swimming element 3 is suddenly rapidly moved in response thereto. This permits the observer to be impressed as if the swimming element is living. Thus, the swimming element 3 exhibits fun sufficient to attract an observer's interest. Also, motion of the swimming element 3 in a wavering manner permits the observer to unconsciously relax, so that the observer may be soothed or healed.

In the illustrated embodiment, the sensor is constituted by a microphone which functions to detect sound. However, it is not limited to a microphone. It may be a pyroelectric sensor for detecting infrared rays generated from the human body, so that approach of an observer to the aquarium may permit continuous driving of the motor. Alternatively, it may be a vibration sensor, so that tapping of the aquarium by an observer may leads to continuous rotation of the motor, to thereby increase a speed of motion of the swimming element. The motor may be constituted by a pulse motor.

The number of sensors to be arranged is not limited to one. The sensor may be a combination of a plurality of sensors, so that detection of various circumstantial changes by the combination may leads to a variation in motion of the swimming element in a variety of ways.

The sensor is not limited to such a sound sensor or vibration sensor as described above. It may be a pyroelectric sensor, a photosensor or the like. Such a sensor exhibits substantially the same function as the sound or vibration sensor, to thereby permit motion of the swimming element to be accelerated, because it detects movement of an observer.

Figure 9:
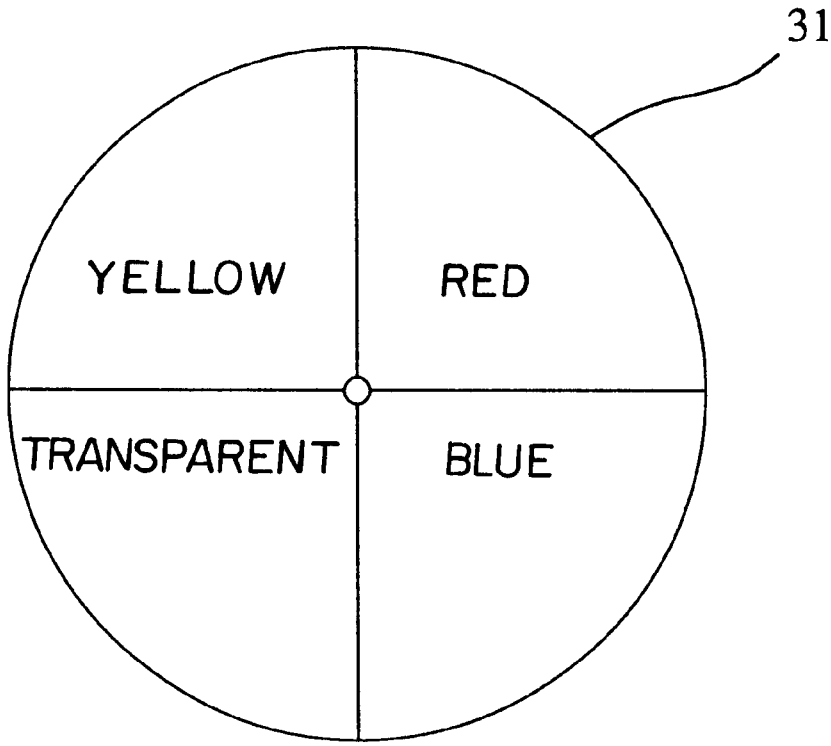
FIG. 9 is a plan view showing a rotation plate.
Figure 10:
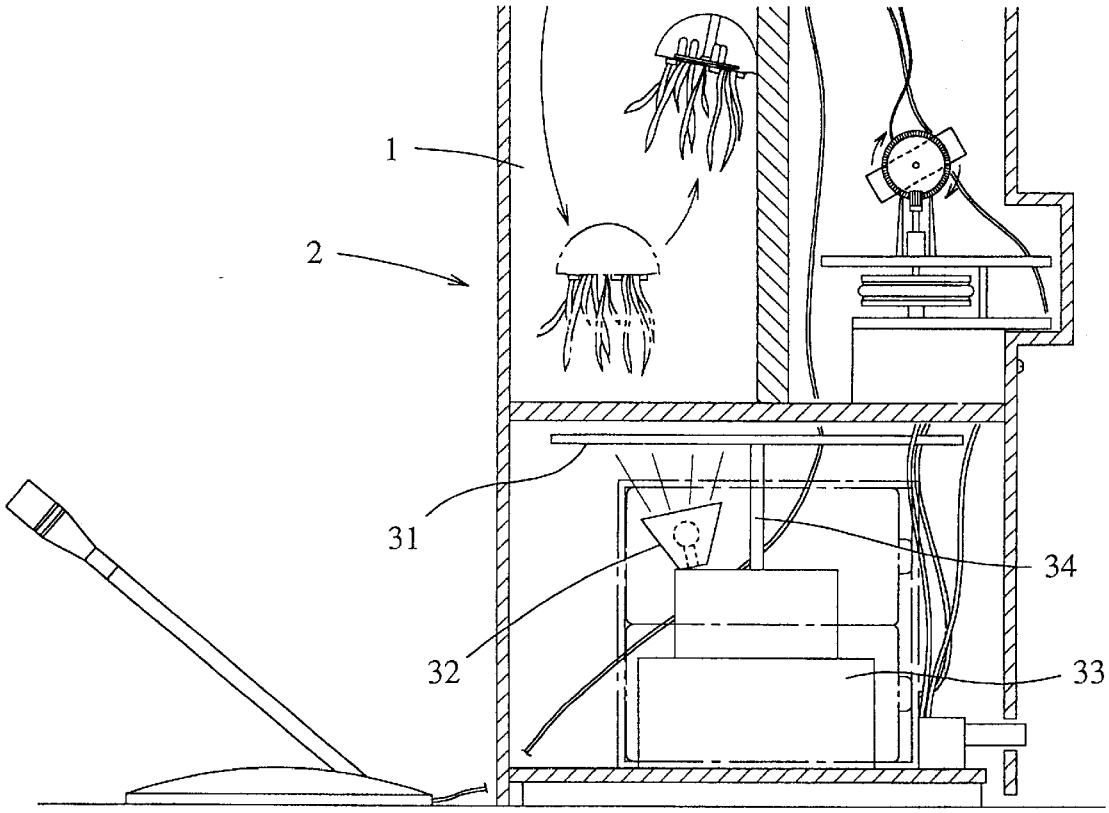
FIG. 10 is a sectional view showing a rotation plate and a drive unit therefor.

The swimming element enjoying system of the illustrated embodiment, as shown in FIGS. 9 and 10, may further include a light-permeable rotation plate 31 classified into a plurality of colors, an illumination means 32 for upwardly emitting light toward the rotation plate 31 from below and a rotation drive unit 33 for rotating the rotation plate 31, which are arranged below the transparent bottom side plate member. The rotation plate 31 is so arranged that a half thereof projects from the bottom of the aquarium 1. The rotation drive unit 33 is constituted by a motor (not shown) and a reduction gear (not shown) including a revolving shaft 34, which is fixedly mounted thereon with the rotation plate 31. Thus, when the illumination means 32 upwardly illuminates the rotation plate 31 from below and the motor is driven for rotation, the rotation plate 31 is slowly rotated, so that light colored by any of colored portions of the rotation plate 31 positionally corresponding to the bottom of the aquarium 1 may be projected into the aquarium 1. A color of the light is varied with rotation of the rotation plate 31, therefore, the light thus varied in color is projected to the swimming element 3, resulting in the swimming element 3 being intermittently varied in color.

Thus, the above-described construction of the swimming element enjoying system permits a color of the swimming element 3 moving in the water and a color of the background of the aquarium 1 to be delicately varied; so that particularly when a circumstance in which the swimming element enjoying system of the illustrated embodiment is placed such as a room or the like is dark, the system permits an observer to nourish an illusion sufficient to keep the observer from losing his or her interest.

As can be seen from the foregoing, the swimming element enjoying system of the present invention permits the swimming element being moved at a predetermined rhythm in the water to act as if it is surprised, when the sensor detects an external stimulus. This results in the swimming element being quickly moved, so that an observer may be impressed as if the swimming element is living. Also, the swimming element is permitted to move in response to an action of an observer, so that the observer may feel strong affinities with the swimming element. Thus, the swimming element exhibits fun sufficient to attract an observer's interest. Further, the swimming element moves in a wavering manner in the water, to thereby permit the observer to unconsciously relax, so that he or she may be soothed or healed.

Also, in the present invention, the motor is intermittently driven by the pulse drive signal in a normal state, so that the swimming element is permitted to slowly move as a whole. When the sensor detects an external stimulus, resulting in the drive signal being continuously outputted, the motor is permitted to continuously rotate. This leads to an increase in rotational speed of the motor, so that motion of the swimming element may be randomly varied.

Further, the present invention may be constructed so that the rotation drive unit is actuated while keeping the illumination means illuminating the rotation plate from below, resulting in the rotation plate being slowly rotated. This permits light colored by the colored portion of the rotation plate positionally corresponding to the bottom of the aquarium to be introduced into the aquarium. Also, a color of the light is intermittently varied with rotation of the rotation plate and the light thus varied in color is projected to the swimming element, resulting in the swimming element being intermittently varied in color. Thus, when a room in which the swimming element enjoying system is placed is dark, the system provides an observer with an illusion sufficient to keep the observer from losing his or her interest.

Furthermore, the swimming element has specific gravity set so as to be permit said swimming element to gently sink in the liquid when it is placed in the liquid. This permits the swimming element to be randomly efficiently moved in the vertical direction due to magnetic attraction/repulsion between the permanent magnets.

Moreover, the sensor may be a sound sensor. Thus, when an observer generates voice or sound, the swimming element is permitted to quickly move, so that the observer may be impressed as if the swimming element is living.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A swimming element enjoying system comprising:

a body including an aquarium in which liquid is stored;

a swimming element moved in said aquarium; and a drive unit for randomly moving said swimming element in said aquarium;

said swimming element and drive unit each being provided with a permanent magnet;

said permanent magnet of said drive unit being rotated by means of a motor, to thereby permit an attracting/repulsing action to be carried out between said permanent magnets, leading to random vertical motion of said swimming element;

said drive unit including a sensor for detecting an external stimulus and a control circuit for varying a rotational speed of said motor when said sensor detects the external stimulus, wherein said control circuit includes a pulse generation circuit for generating a pulse and a selection circuit for determining whether the pulse generated by said pulse generation circuit is to be outputted in the form of a drive signal on the basis of a result of detection by said sensor;

said drive signal being continuously outputted unless the pulse is outputted as the drive signal.

2. A swimming element enjoying system as defined in claim 1, further comprising a light-permeable rotation plate classified into a plurality of colors, an illumination means for upwardly illuminating said rotation plate from below and a rotation drive unit for rotating said rotation plate;

said rotation plate, illumination means and rotation drive unit being arranged below said body.

3. A swimming element enjoying system as defined in claim 1, wherein said swimming element has specific gravity set so as to permit said swimming element to gently sink in said liquid when it is placed in said liquid.

4. A swimming element enjoying system as defined in claim 1, wherein said sensor is a sound sensor.

5. A toy aquarium kit comprising:

a body including an aquarium in which liquid can be stored;

a swimming element movable in said aquarium; and a drive unit including a motor mounted in said body for moving said swimming element;

said swimming element and drive unit each being provided with a permanent magnet;

said permanent magnet of said drive unit being rotatable by said motor, to thereby permit an attracting/repulsing action to be carried out between said permanent magnets;

said drive unit further including a sensor for detecting an external stimulus and a control circuit for varying a rotational speed of said motor when said sensor detects the external stimulus, the drive unit changes a rotational speed of the motor for a predetermined time period in response to the sensor detection of external stimulus, whereby at least two different speeds are provided to vary the attracting/repulsing action from a first mode of operation to a second mode of operation.

6. A toy aquarium kit as defined in claim 5, wherein said control circuit includes a pulse generation circuit for generating a pulse and a selection circuit for determining whether the pulse generated by said pulse generation circuit is to be outputted in the form of a drive signal on the basis of a result of detection by said sensor;

said drive signal being continuously outputted unless the pulse is outputted as the drive signal.

7. A toy aquarium kit as defined in claim 5, further comprising a light-permeable rotation plate classified into a plurality of colors, an illumination means for upwardly illuminating said rotation plate from below and a rotation drive unit for rotating said rotation plate;

said rotation plate, illumination means, and rotation drive unit being arranged below said body.

8. A toy aquarium kit as defined in claim 5, wherein said swimming element has specific gravity set so as to permit said swimming element to gently sink in said liquid when it is placed in said liquid.

9. A toy aquarium kit as defined in claim 5, wherein said sensor is a sound sensor.

10. A simulated swimming element display system comprising:

a body including an aquarium in which liquid is stored;

a swimming element including a first permanent magnet movable in said aquarium to simulate a life-like swimming motion; and a drive unit including a motor and a second permanent magnet for randomly moving said swimming element in said aquarium;

said second permanent magnet of said drive unit being rotated by means of the motor, to thereby permit an attracting/repulsing action to be carried out between said first and second permanent magnets, leading to random vertical motion of said swimming element;

a control circuit for driving the motor at a first speed to provide a first level of simulated swimming motion for the swimming element;

a sensor unit for detecting an external stimulus adjacent the aquarium and providing a corresponding signal; and a selection circuit responsive to the sensor unit signal to provide an output signal for the control circuit to drive the motor at a second speed different from the first speed for a predetermined time period to provide a second level of simulated swimming motion for the swimming motion for the swimming element.

11. A simulated swimming element display system as defined in claim 10, further comprising a light-permeable rotation plate having a plurality of colors, an illumination means for upwardly illuminating said rotation plate from below and a rotation drive unit for rotating said rotation plate;

said rotation plate, illumination means, and rotation drive unit being arranged below said aquarium.

12. A simulated swimming element display system as defined in claim 10, wherein said swimming element has a predetermined specific gravity which permits said swimming element to gently sink in said liquid when it is placed in said liquid.

13. A simulated swimming element display system as defined in claim 10, wherein said sensor unit is a sound sensor.

* * * * *